US006517330B2

(12) United States Patent
Hironaka et al.

(10) Patent No.: US 6,517,330 B2
(45) Date of Patent: Feb. 11, 2003

(54) RECIPROCATING PUMP

(75) Inventors: Yoshiaki Hironaka, Saitama (JP); Tadashige Kondo, Tokyo (JP); Kiyoshige Enomoto, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 9 days.

(21) Appl. No.: 09/850,304

(22) Filed: May 7, 2001

(65) Prior Publication Data

US 2001/0043873 A1 Nov. 22, 2001

(30) Foreign Application Priority Data

May 10, 2000 (JP) ..... 2000-137643

(51) Int. Cl.[7] ..... F04B 17/00; F04B 17/04; F04B 7/04

(52) U.S. Cl. ..... 417/415; 417/417; 417/490; 417/570

(58) Field of Search ..... 417/415, 417, 417/490, 570

(56) References Cited

U.S. PATENT DOCUMENTS

| | | | | | |
|---|---|---|---|---|---|
| 4,016,787 | A | * | 4/1977 | Sugimoto | 83/13 |
| 4,695,852 | A | * | 9/1987 | Scardovi | 347/14 |
| 5,176,120 | A | * | 1/1993 | Takahashi | 123/446 |
| 5,800,139 | A | * | 9/1998 | Yamada | 417/417 |
| 5,836,521 | A | * | 11/1998 | Holm et al. | 239/584 |

FOREIGN PATENT DOCUMENTS

| | | | | |
|---|---|---|---|---|
| EP | 49702 A | * | 4/1982 | F02D/5/02 |
| JP | 6114404 | | 6/1986 | |

* cited by examiner

*Primary Examiner*—Charles G. Freay
*Assistant Examiner*—Michael K. Gray
(74) *Attorney, Agent, or Firm*—Baker Botts LLP

(57) ABSTRACT

A reciprocating pump includes a chamber, a reciprocating member arranged to induct a fluid into the chamber and discharge the fluid from the chamber to a delivery side of the pump, and a piezoelectric element attached to the pump and arranged to detect pressure fluctuations on the delivery side of the pump so as to sense any abnormality in the inducting and discharging of fluid.

5 Claims, 4 Drawing Sheets

Normal
Output from piezoelectric element
Solenoid
ON
OFF
t

Cut-off of oil
Output from piezoelectric element
Solenoid
ON
OFF
t

Clogging on delivery side
Output from piezoelectric element
Solenoid
ON
OFF
t

Normal

Cut-off of oil

Clogging on delivery side

RECIPROCATING PUMP

BACKGROUND OF THE INVENTION

The present invention relates to a reciprocating pump for inducting and discharging fluid by means of a reciprocating member, such as a piston, a plunger, or the like, and, in particular, to a reciprocating pump provided with a malfunction-detector for detecting malfunctions such as an induction failure and a failure to discharge a fluid under pressure to a destination.

A conventional reciprocating pump employed for the lubrication of a small air-cooled, two-stroke cycle gasoline engine (hereinafter referred to simply as an engine), which is suitable for use as a power source for a portable power working machine such as a chain saw, is shown in FIG. 3. The pump 2 includes a main body 60 having a cylinder portion 65 that is provided with an induction port 66 and a discharge port 67. The discharge port 67 is opened and closed by a ball valve 75. One end of a plunger rod 71 is affixed, such as by press-fitting, to a main plunger body 72 of a reciprocating member 70. The other end of the plunger rod is slidably received in the cylinder portion 65. A solenoid 80 attached to one end portion (on the right side in the drawing) of the main body 60 drives the reciprocating member 70. A delivery passageway member 90 is threaded into the other end portion (on the left side in the drawing) of the main body 60.

The ball valve 75 is normally urged in a direction to close the discharge port 67 by means of a coil spring 74, which is interposed between the ball valve 75 and the delivery passageway member 90. The reciprocating member 70 is normally urged toward the right side of the drawing by means of a coil spring 78 which is interposed between the cylinder portion 65 and the main plunger body 72.

The solenoid 80 is secured between the main body 60 and a retainer sleeve 84, which is threaded onto the outer circumferential wall of one end of the main body 60. A cupshaped cover 85 fits over and is affixed to the outer circumferential wall of the retainer sleeve 84.

The solenoid 80 is energized by current pulses supplied to it at a predetermined cycle from an outside power source (not shown) by electrical conductors (not shown) that pass through a hole 68 in the main body 60. When the solenoid 80 is switched to OFF from ON, the reciprocating member 70 is caused to move rightward in the drawing due to the urging force of the coil spring 78, thereby moving the plunger rod 71 in a direction to open the induction port 66. As a result, fluid (lubricating oil for the engine) is permitted to flow into a valve chamber 61 which is formed between the plunger rod 71 and the ball valve 75, and at the same time, a rear flange portion 73 of the main plunger body 72 engages and is stopped by the cover 85. FIG. 3 shows the state of the pump 2 when the solenoid 80 is OFF.

When the solenoid 80 is switched to ON, the reciprocating member 70 is caused to move leftward in the drawing due to the generation of magnetic force, thereby moving the plunger rod 71 in a direction to close the induction port 66, and at the same time, the fluid in the valve chamber 61 is pressurized so as to push the ball valve 75 open (leftward in the drawing). The flange portion 73 of the main plunger body 72 engages a plastic buffer plate 88 adhered to the right end face of the retainer sleeve 84. As a result, the discharge port 67 is opened, thus permitting the fluid in the valve chamber 61 to flow into the delivery passageway member 90.

When the pump 2 of FIG. 3 is installed on an engine, lubricating oil in an oil tank (not shown) is inducted through an oil strainer and an inlet pipe (not shown) into the valve chamber 61 from the induction port 66. The lubricating oil thus inducted into the valve chamber 61 is then pressurized and is discharged from the pump 2 through the discharging port 67, the ball valve 75, a delivery passageway 92 in the delivery passageway member 90, a check valve 95 disposed at the delivery port of the delivery passageway 92, and an oil delivery pipe (not shown) coupled with the delivery passageway member 90, to the destination, i.e., the moving parts of the engine.

Like any pump, the reciprocating pump described above may malfunction. For example, the induction side of the pump may become clogged so that the oil is no longer normally inducted, or air may be inducted with the oil due to a leak in the line leading to the pump from the supply tank. Also, the pipe leading from the discharge side of the pump may become clogged, thereby making it impossible to feed the oil to the destination thereof. In the event of a malfunction of the pump, it is desirable to stop the engine to avoid seizure or to provide an alarm, warning of the malfunction.

It is conventional to attach a pressure sensor to the reciprocating pump so as to detect a fluctuation of pressure at the delivery port. In this case, the aforementioned abnormalities in the operation of the pump can be detected based on an output (detection signal) emitted from the pressure sensor.

More specifically, as shown in FIG. 3, a take-off port 97 is provided on the delivery passageway member 90 so as to provide via a rigid pipe 98, for instance, a quantity of oil present at the delivery port (a delivery pressure) to a pressure sensor 100, which detects fluctuations of pressure at the delivery port. Suitable pressure sensors 100 include transducer type sensors, which are designed to generate an electric signal after converting the delivery pressure of oil into another kind of physical quantity (such as the magnitude of displacement) by making use of a diaphragm or the like. Transducer-type sensors include those having a strain gage adhered to a diaphragm, those having a coil and a core symmetrically arranged on both sides of a magnetic diaphragm so as to constitute an equilibrium magnetic circuit, and those in which a conductive diaphragm and an electrode are arranged to face each other so as to constitute a pair of capacitors. The foregoing types are available commercially.

In previously used types of pressure sensors, the output of the pressure sensor 100 changes synchronously with the ON/OFF operation (the discharging and inducting operation by the reciprocating member 70) of the solenoid 80 as shown in FIGS. 4(A) to 4(C). When the oil is normally supplied without the aforementioned abnormalities, the output of the pressure sensor 100 becomes wavy, as shown in FIG. 4(A); when the oil is cut off, the sensing of a change in output from that of the normal operation slightly lags in time behind (due to the entrainment of air) and at the same time, the amplitude of output is slightly reduced, as shown in FIG. 4(B); and when the clogging of oil occurs on the delivery side of the pump, the output of the pressure sensor 100 is greatly increased, as shown in FIG. 4(C). Therefore, it becomes possible, through the processing of the output of the pressure sensor 100, to detect the type of abnormality in the operation of the pump.

The pressure sensors which are generally available commercially, such as those mentioned above, are somewhat expensive for use in detecting abnormalities, such as the cutoff of oil from the pump intake or the clogging of oil on the delivery side, of a reciprocating pump employed for the lubrication of the engine of a portable working machine such as a chain saw. In addition to the relatively high cost, it is also required in the case of the aforementioned pressure sensors to introduce a fluid such as oil directly into the pressure sensor, thereby raising a problem of the space for mounting the aforementioned pressure sensors on the reciprocating pump.

SUMMARY OF THE INVENTION

The present invention has been made in response to the aforementioned needs. In particular, it is an object of the present invention to provide in a reciprocating pump a detector that is capable of reliably detecting abnormalities in the inducting and discharging of fluid, such as the cut-off of oil from the pump intake or the clogging of oil on the delivery side of the pump, by a detector that is inexpensive and relatively simple in structure.

With a view to attaining the aforementioned object, the present invention provides a reciprocating pump having a chamber, a reciprocating member arranged to induct a fluid into the chamber and discharge the fluid from the chamber to a delivery side of the pump, and a piezoelectric element attached to the pump and arranged to detect pressure fluctuations on the delivery side of the pump so as to sense any abnormality in the inducting and discharging of fluid.

In a preferred embodiment, the piezoelectric element is of tubular configuration and is fitted on an outer wall of a delivery passageway member which constitutes the delivery side of the pump. An insulating member may be interposed between the piezoelectric element and the delivery passageway member.

In advantageous arrangements, a tubular piezoelectric element is engaged between a flange portion of the delivery passageway member and a main body of the pump. An insulating member may be interposed between the piezoelectric element and the delivery passageway member, and another insulating member may be interposed between the piezoelectric element and the main body.

The reciprocating pump may be of a type in which the chamber is defined by a cylinder portion of the main body. The cylinder portion has an induction port and a discharge port. The discharge port is opened and closed by a valve and when opened discharges the fluid to the output side, such as the aforementioned delivery passageway member. The reciprocating member is received for reciprocating movement in the chamber of the cylinder portion to thereby induct the fluid into the chamber through the induction port and discharge the fluid from the discharge port to the delivery passageway member. A solenoid drives the reciprocating member.

The reciprocating pump according to the present invention is well suited for use as an oil pump to supply a lubricating oil to an engine.

In the operation of a reciprocating pump of the present invention which is constructed as described above, the delivery passageway member expands and contracts due to a fluctuation of pressure of the fluid present on the delivery side of the reciprocating pump. The forces resulting from the deformation of the delivery passageway member are transmitted via the insulating member to the piezoelectric element. As a result, the piezoelectric element expands or contracts, and hence the output (detected signals) from the piezoelectric element change, depending on the aforementioned fluctuation of pressure.

The output from the piezoelectric element is essentially identical with the output of the aforementioned previously used pressure sensors, so that when the output from the piezoelectric element is processed by means of a computer, the type of abnormality in the operation of the pump, such as a cut-off of the supply of oil to the pump intake or the clogging of oil on the discharge side of the pump, can be automatically detected.

Piezoelectric elements of a tubular configuration are available commercially at prices considerably less than those of the aforementioned pressure sensors previously used with engine-lubricating pumps. Additionally, it is not necessary to introduce oil directly into the piezoelectric element. Moreover, the tubular piezoelectric element can be easily fitted on the outer wall of the delivery passageway member and supported between the delivery passageway member and the main body, thereby considerably simplifying the attachment of the piezoelectric element to the pump.

As described above, it is possible according to the present invention to reliably detect abnormalities in the inducting and discharging of fluid such as the cut-off of oil from the supply tank or the clogging of oil on the delivery side by making use of an inexpensive piezoelectric element, which is also relatively simple in structure.

DETAILED DESCRIPTION OF THE INVENTION

Figure 1:
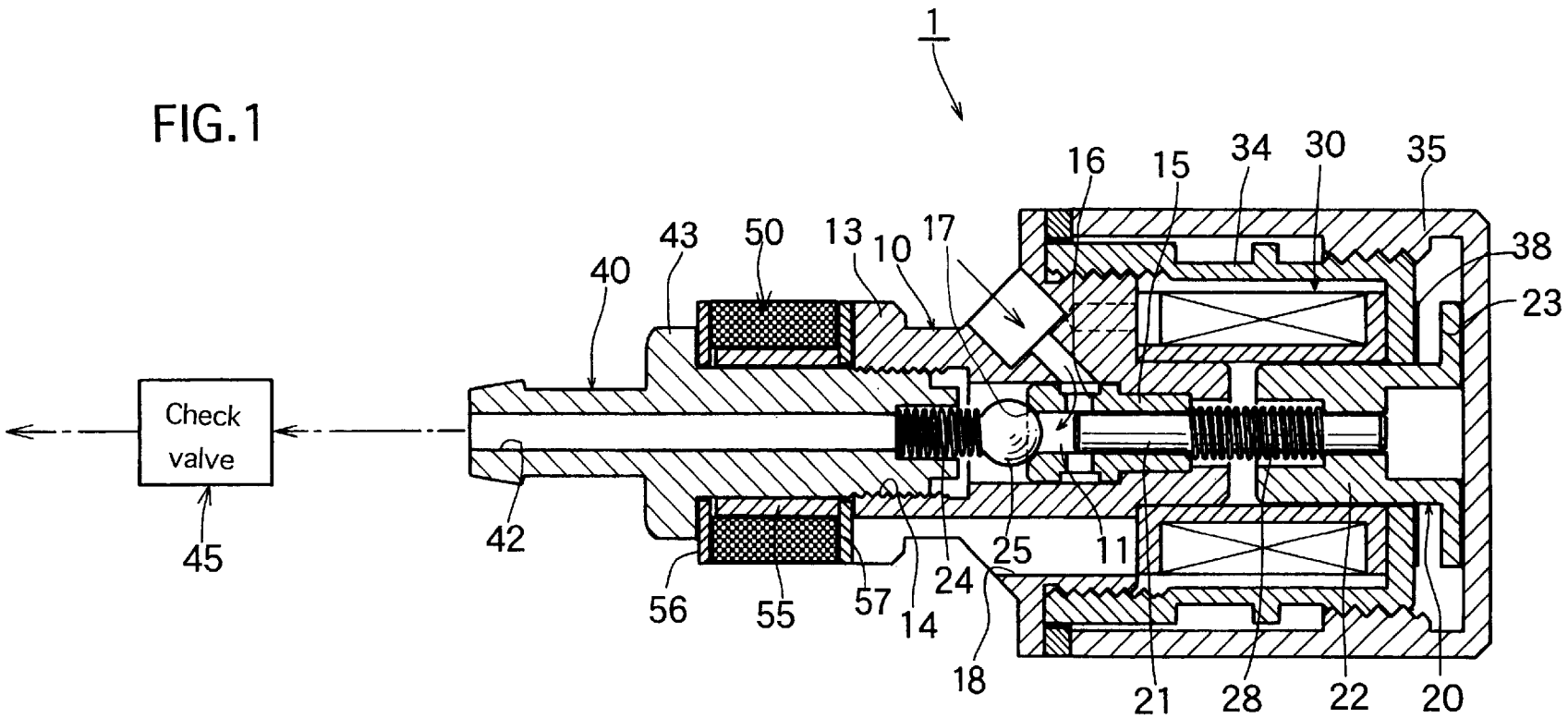
FIG. 1 is a cross-sectional view illustrating one embodiment of the reciprocating pump according to the present invention.
Figure 3:
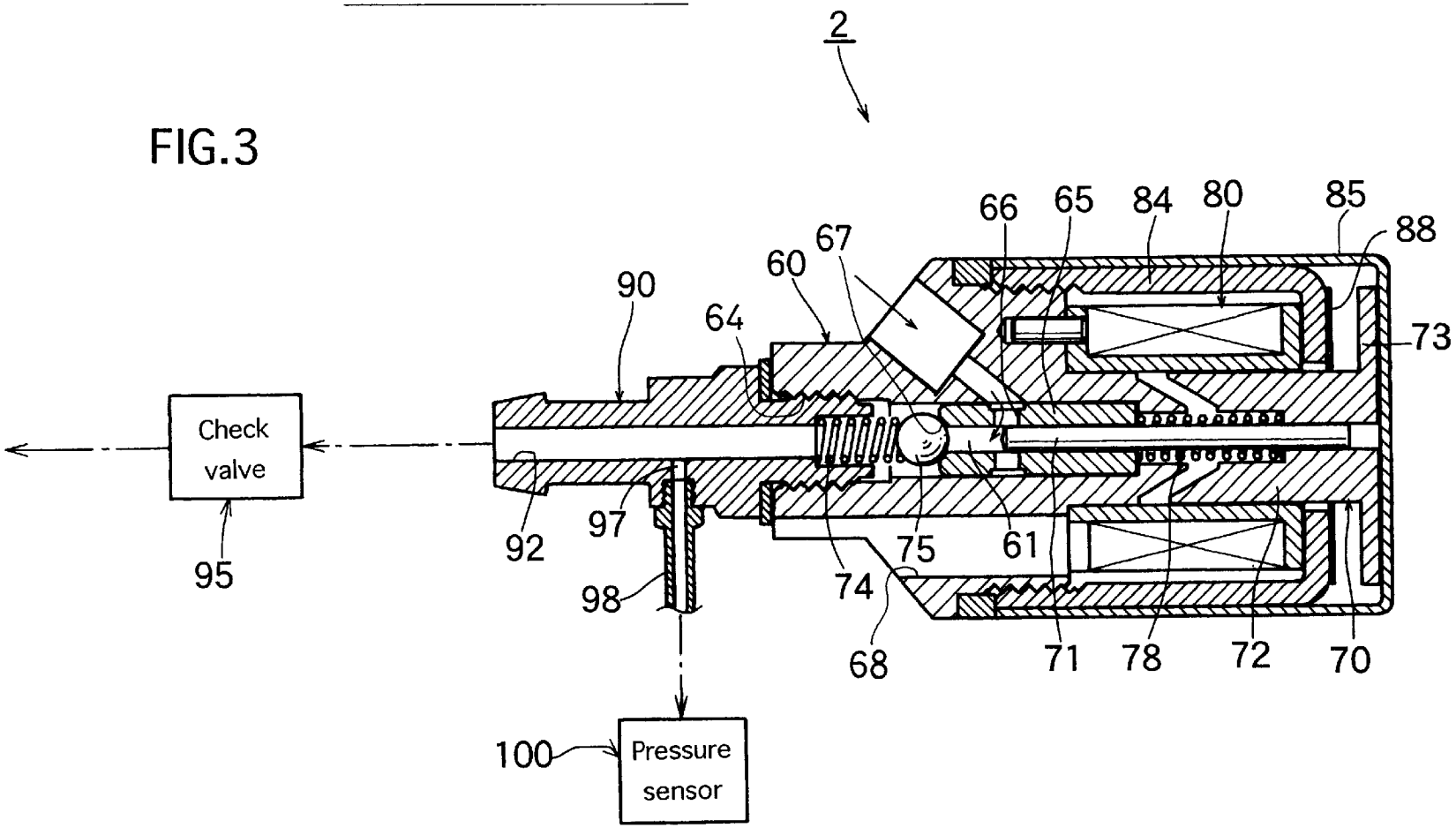
PRIOR ART FIG.3
FIG. 3 is a cross-sectional view illustrating a reciprocating pump according to the prior art.

Referring to FIG. 1, the reciprocating pump 1 is adapted to be employed for the lubrication of a small aircooled two-stroke cycle gasoline engine that is used to power a portable power working machine, such as a chain saw. The pump 1 is similar in many respects to the conventional reciprocating pump 2 that is shown in FIG. 3 and described above.

The reciprocating pump 1 according to the embodiment shown in FIG. 1 includes a main body 10 having a cylinder portion 15 that is provided with an induction port 16 and a discharge port 17. The discharge port 17 is opened and closed by a ball valve 25. One end of a plunger rod 21 is affixed, such as by press-fitting, to a main plunger body 22 of a reciprocating member 20. The other end of the plunger rod 21 is slidably received in the cylinder portion 15. A solenoid 30 attached to one end portion (on the right side in the drawing) of the main body 10 drives the reciprocating member 20. A delivery passageway member 40 is threaded into the other end portion (on the left side in the drawing) of the main body 10.

The ball valve 25 is normally urged in a direction to close the discharging port 17 by means of a coil spring 24, which is interposed between the ball valve 25 and the delivery passageway member 40. The reciprocating member 20 is normally urged toward the right side of the drawing by means of a coil spring 28 which is interposed between the cylinder portion 15 and the main plunger body 22.

The solenoid 30 is secured between the main body 10 and a retainer sleeve 34, which is threaded onto the outer circumferential wall of one end of the main body 10. A cup-shaped cover 35 fits over and is affixed to the outer circumferential wall of the retainer sleeve 34.

The solenoid 30 is energized by current pulses supplied to it at a predetermined cycle from an outside electric power source (not shown) by electrical conductors (not shown) that pass through a hole 18 in the main body 10. When the solenoid 30 is switched to OFF from ON, the reciprocating member 20 is caused to move rightward in the drawing due to the urging force of the coil spring 28, thereby moving the plunger rod 21 in a direction to open the induction port 16. As a result, fluid (lubricating oil for the engine) is permitted to flow into a valve chamber 11 which is formed between the plunger rod 21 and the ball valve 25, and at the same time, a rear flange portion 23 of the main plunger body 22 engages and is stopped by the cover 35. FIG. 1 shows the state of the pump 1 when the solenoid 30 is OFF.

When the solenoid 30 is switched to ON (energized), the reciprocating member 20 is caused to move leftward in the drawing due to the generation of magnetic force, thereby moving the plunger rod 21 in a direction to close the induction port 16, and at the same time, the fluid in the valve chamber 11 is pressurized so as to push the ball valve 25 open (leftward in the drawing). The flange portion 23 of the main plunger body 22 engages a plastic buffer plate 38 adhered to the right end face of the retainer sleeve 34. As a result, the discharge port 17 is opened, thus permitting the fluid in the valve chamber 11 to flow into the delivery passageway member 40.

When the pump 1 of FIG. 1 is installed on an engine, lubricating oil in an oil tank (not shown) is inducted through an oil strainer and an inlet pipe (not shown) into the valve chamber 11 from the induction port 16. The lubricating oil thus inducted into the valve chamber 11 is then pressurized and is discharged from the pump 1 through the discharge port 17, the ball valve 25, a delivery passageway 42 in the delivery passageway member 40, a check valve 45 disposed at the delivery port of the delivery passageway 92, and an oil delivery pipe (not shown) coupled with the delivery passageway member 40, to the destination, i.e., the moving parts of the engine.

The embodiment of FIG. 1 further includes, as an abnormality-detector for detecting if any abnormality occurs in the inducting and discharging of lubricating oil, a cylindrical piezoelectric element 50. The piezoelectric element 50, which is available commercially, is fitted on the outer wall of the delivery passageway member 40 and supported between a flange portion 43 of the delivery passageway 40 and the flange portion 13 of the main body 10. For the purpose of preventing the operation of the piezoelectric element 50 from being affected by leakage of electrical current, a cylindrical inner insulating member 55 and disk-like insulating members 56 and 57 are interposed between the piezoelectric element 50 and the adjacent surfaces of the delivery passageway member 40 and the main body 10. The piezoelectric element 50 is preloaded with a predetermined compressive load between the flange portions 43 and 13. The output signals from the piezoelectric element 50 are conducted through a conductor (not shown), which is electrically connected with one end face of the piezoelectric element 50.

The delivery passageway member 40 expands and contracts due to fluctuations of pressure caused by the ejection of lubricating oil when the solenoid 30 is turned ON. Hence a force resulting from the deformation of the delivery passageway member 40 is transmitted via the insulating members 55, 56 and 57 to the piezoelectric element 50. As a result, the piezoelectric element 50 is caused to expand or shrink, and a voltage output, which is proportional to the magnitude of expansion and contraction of the piezoelectric element 50, is generated.

Figures 2A, 2B, 2C:
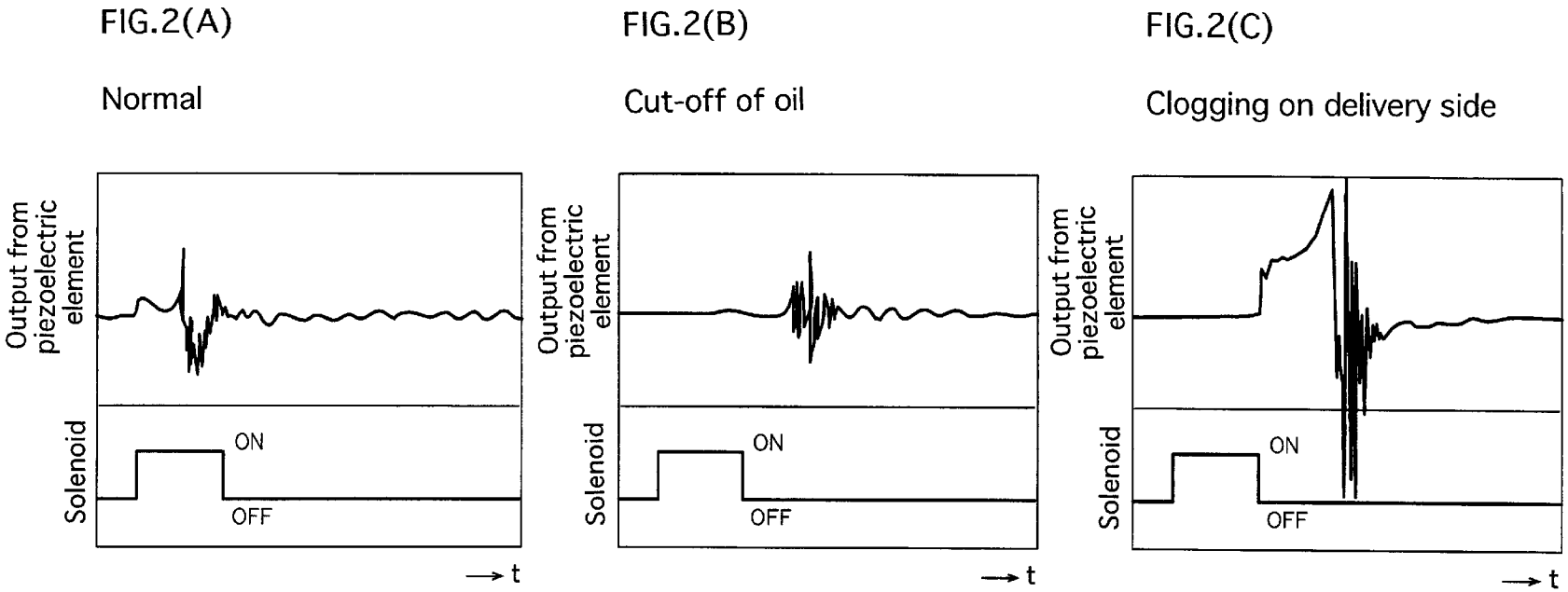
FIGS. 2(A), 2(B) and 2(C) are graphs that show changes in the output of the piezoelectric element employed in the reciprocating pump shown in FIG. 1 in the normal operation as well as in abnormal operations of the pump.
Figure 4A:
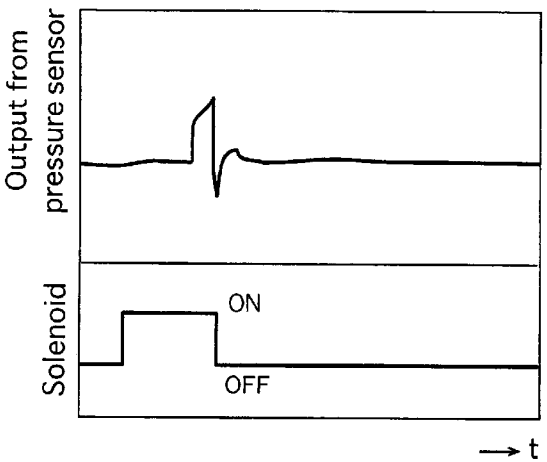
PRIOR ART FIG.4(A)
FIGS. 4(A), 4(B) and 4(C) are graphs that illustrate changes in output of the pressure sensor employed in the prior art reciprocating pump shown in FIG. 3 in the normal operation as well as in abnormal operations of the pump.
Figure 4B:
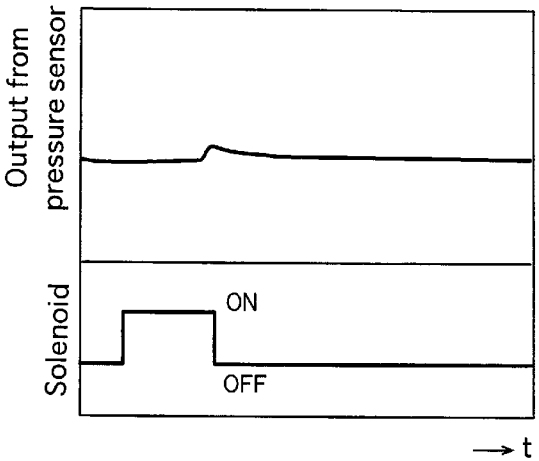
Figure 4C:
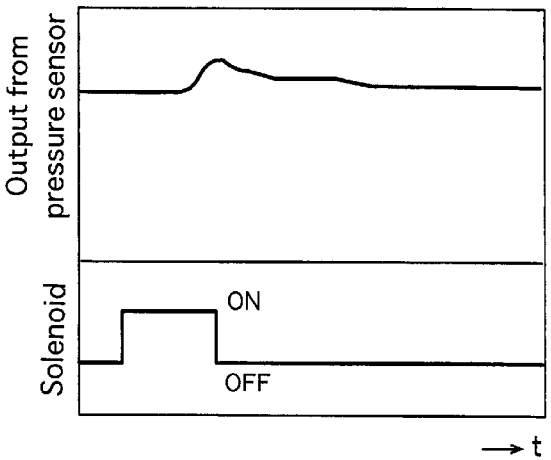

In essentially the same manner as the output of the conventional pressure sensor 100 (FIG. 4) mentioned previously, the output of the piezoelectric element 50 changes synchronously with the ON/OFF operation (the discharging and inducting operation by the reciprocating member 20) of the solenoid 30, as shown in FIGS. 2(A) to 2(C). When the oil is normally inducted and discharged without abnormalities, the output of the piezoelectric element 50 becomes wavy as shown in FIG. 2(A); when no oil is inducted into the pump, the signal output lags slightly behind that of the normal operation (due to the entrainment of air) and at the same time, the amplitude of output is slightly reduced, as shown in FIG. 2(B); and when the clogging of oil occurs on the delivery side, the amplitude of output of the piezoelectric element 50 is greatly increased, as shown in FIG. 2(C). Therefore, it becomes possible, through the processing of the output (detected signals) of the piezoelectric element 50, to automatically detect the type of abnormality such as a cut-off of oil induction or a blockage of oil discharge on the oil delivery side.

The piezoelectric element 50 of ring-like or cylindrical configuration can be purchased from commercial sources at a considerably lower price as compared with the aforementioned conventional pressure sensors. Additionally, it is no longer required to introduce fluid such as oil (a delivery pressure) directly into the piezoelectric element 50. Moreover, the ring-like or cylindrical piezoelectric element can be easily fitted on the outer wall of the delivery passageway member 40 and supported between the delivery passageway member 40 and the main body 10, thereby making it possible to simplify the attachment of the piezoelectric element 50.

As described above, the reciprocating pump 1 of the embodiment reliably detects abnormalities in the inducting and discharging of oil by making use of an inexpensive piezoelectric element which is also relatively simple in structure.

Although an embodiment of the present invention has been described above and shown in the drawings, it should be understood that the present invention is not limited to the embodiment, but can be varied without departing from the spirit and scope of the invention set forth in the accompanying claims. For example, in the embodiment, the cylindrical piezoelectric element 50 is fitted on the outer wall of the delivery passageway member 40. A piezoelectric element (i.e., a piezoeletric sensor) may be substituted for the pressure sensor 100 (where a diaphragm is employed) in the conventional reciprocating pump 2 shown in FIG. 3. It is still advangtageous in this case, also in terms of manufacturing cost as compared with the case where the aforementioned pressure sensor 100 is employed.

What is claimed is:

1. A reciprocating pump comprising a chamber, a reciprocating member arranged to induct a fluid into the chamber and discharge the fluid from the chamber to a delivery side of the pump, and a piezoelectric element attached to the pump and arranged to detect pressure fluctuations on the delivery side of the pump so as to sense any abnormality in the inducting and discharging of fluid, wherein the chamber is defined by a cylinder portion of a main body, the cylinder portion has an induction port and a discharge port, the discharge port is opened or closed by a valve and when opened discharges the fluid to the discharge side, the reciprocating member is received for reciprocating movement in the chamber of the cylinder portion to thereby induct the fluid into the chamber through the induction port and discharge the fluid from the discharge port, and a solenoid drives the reciprocating member.

2. The reciprocating pump according to claim 1, wherein the piezoelectric element is of tubular configuration and is fitted on an outer wall of a delivery passageway member which constitutes the delivery side of the pump.

3. The reciprocating pump according to claim 2, wherein the piezoelectric element is engaged between a flange portion of the delivery passageway member and the main body.

4. The reciprocating pump according to claim 2, wherein an insulating member is interposed between the piezoelectric element and the delivery passageway member.

5. The reciprocating pump according to claim 3, wherein an insulating member is interposed between the piezoelectric element and the delivery passageway member and an insulating member is interposed between the piezoelectric element and the main body.

* * * * *